US006655564B1

(12) United States Patent
Zupan

(10) Patent No.: US 6,655,564 B1
(45) Date of Patent: Dec. 2, 2003

(54) BACK STRAP

(76) Inventor: Joseph Zupan, 10 Farmers Tphe, Modena, NY (US) 12548

( * ) Notice: Subject to any disclaimer, the term of this patent is extended or adjusted under 35 U.S.C. 154(b) by 39 days.

(21) Appl. No.: 10/115,644

(22) Filed: Apr. 5, 2002

(51) Int. Cl.[7] ..... B65D 71/02; A45F 3/04

(52) U.S. Cl. ..... 224/628; 224/259; 224/604; 224/627

(58) Field of Search ..... 224/627–629, 224/651, 907, 262, 600, 259, 604; 294/150, 151, 137, 138

(56) References Cited

U.S. PATENT DOCUMENTS

| | | | | | |
|---|---|---|---|---|---|
| 224,250 | A | * | 2/1880 | Tollner | 294/146 |
| 1,411,175 | A | * | 3/1922 | Maguire | 294/152 |
| 1,580,256 | A | * | 4/1926 | Keeler | 294/151 |
| 1,663,708 | A | * | 3/1928 | Keeler | 294/151 |
| 2,407,714 | A | * | 9/1946 | Maloney | 224/259 |
| 2,532,306 | A | * | 12/1950 | Herbert | 224/49 |
| 3,933,287 | A | * | 1/1976 | Foley | 224/55 |
| 4,061,259 | A | * | 12/1977 | Hurst | 224/51 |
| D249,190 | S | | 8/1978 | Stewart | |
| 4,462,525 | A | | 7/1984 | Pingleton | |
| 4,487,443 | A | * | 12/1984 | Adamick | 294/151 |
| 5,131,576 | A | * | 7/1992 | Turnipseed | 224/262 |
| 5,181,638 | A | | 1/1993 | McHale | |
| 5,228,609 | A | | 7/1993 | Gregory | |
| 5,481,767 | A | * | 1/1996 | Lewis | 224/259 |
| 5,725,139 | A | | 3/1998 | Smith | |
| 5,836,489 | A | | 11/1998 | Swetish | |

* cited by examiner

*Primary Examiner*—Sue A. Weaver
(74) *Attorney, Agent, or Firm*—Richard L. Mikesell

(57) ABSTRACT

A back strap for carrying objects, such as books, includes a base upon which the objects are placed. A first shoulder strap defines a handle at one end thereof, and extends through aligned apertures of the base to form a loop over a base. A second should strap, defining a handle at one end thereof, similarly extends through aligned apertures of the base to form another loop over the base. A side strap extends from one side of the base to the opposite side of the base, generally transverse to the first and second shoulder straps, to form a loop over the base. Adjustment mechanisms associated with the first and second shoulder strap and side strap allow for the adjusting of the length of the loops over the base to securely tighten objects onto the base for transport.

10 Claims, 1 Drawing Sheet

BACK STRAP

BACKGROUND OF THE INVENTION

The present invention generally relates to articles, such as backpacks, which enable the carrying of books and other objects. More particularly, the present invention relates to a back strap for carrying such objects in an unconcealed manner.

The crime rate in many areas of the country has risen dramatically over the past few decades. Many of these crimes are drug related, but they also consist of random acts of violence. Sadly, school age children are committing a large number of these crimes. Some of these children belong to gangs which encourage their violent acts. Others have problems at home which cause them to have violent outbursts.

For this reason, many schools have had to develop tighter security in order to keep the students safe from such children. Some schools have hired security officers to patrol the halls. Other schools have had to resort to installing metal detectors at each of its entrances to prevent students from carrying weapons, and even bombs, into the building. One precaution that many schools have enacted is the prohibition of backpacks on school grounds. These backpacks can serve as the perfect means to transport weaponry, as well as drugs, into the school. Students are then forced to carry their materials into the school by hand, which can prove a rather awkward task, especially when the child is given ample amounts of homework.

Accordingly, there is a need for a device which provides students with a convenient way to transport their school books and materials without the use of a backpack. Such a device should also readily reveal what the student is carrying, preventing any breaches in security. The present invention fulfills these needs, and provides other related advantages.

SUMMARY OF THE INVENTION

The present invention resides in a back strap for carrying objects, such as books, in order to provide students a convenient way to transport their school books and other materials, while readily revealing the contents carried by back strap for security purposes.

The back strap generally comprises a base having a pair of spaced apart upper apertures adjacent to a top edge thereof, and a pair of spaced apart lower apertures adjacent to a bottom edge thereof. A first shoulder strap, having a first end defining a handle, extends through a first upper aperture and through a first lower aperture. A second end is attached to the strap intermediate the first and second end, to form a loop over the base. Similarly, a second shoulder strap having a first end defining a handle is extended through a second upper aperture and through a second lower aperture. The second end is attached to the strap intermediate the first and second ends to form a loop over the base, similar to the first shoulder strap. An adjustment mechanism is associated with each of the first and second shoulder straps for adjusting the length of each shoulder strap loop over the base. Typically, the first and second shoulder straps include clasps intermediate the first and second ends, usually in the form of mating ends of a buckle, one of which includes the adjustment mechanism.

A side strap extends from one side of the base to the opposite side of the base so as to be generally transverse to the first and second shoulder straps. The base is generally planar and quadrilateral in configuration so as to easily support the books and other objects. Typically, the base includes side apertures through which first and second side straps are attached and clasped together, such as by mating ends of a buckle, to form a loop over the base. An adjustment mechanism is associated with the side strap, typically on one end of the buckle, for adjusting the length of the side strap loop over the base.

In use, objects are placed on the base and securely strapped thereto by tightening the first and second shoulder straps, and side strap over the objects. The base and objects are then carried over one's shoulder, and the back strap grasped at the shoulder strap handles, comprised of a loop formed by attaching the first ends to the strap.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
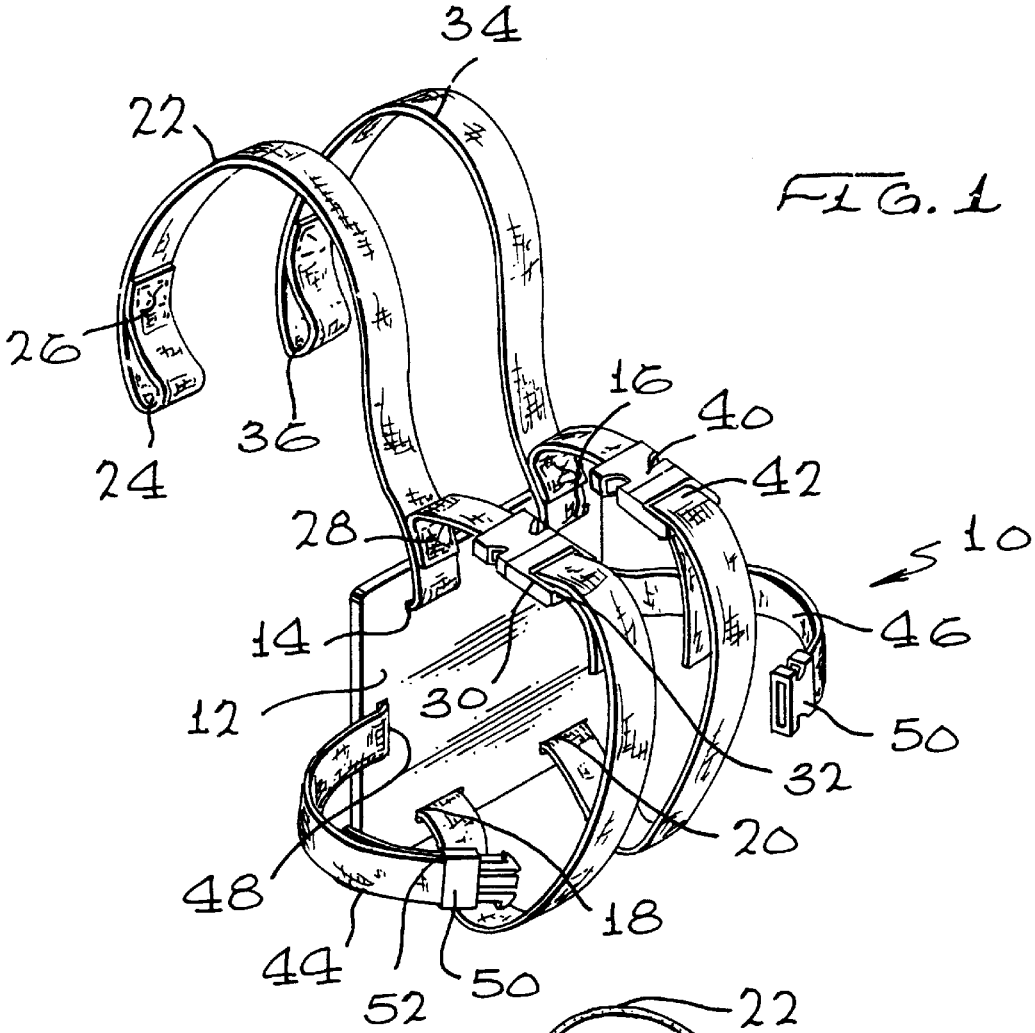
FIG. 1 is a perspective view of a back strap embodying the present invention.
Figure 2:
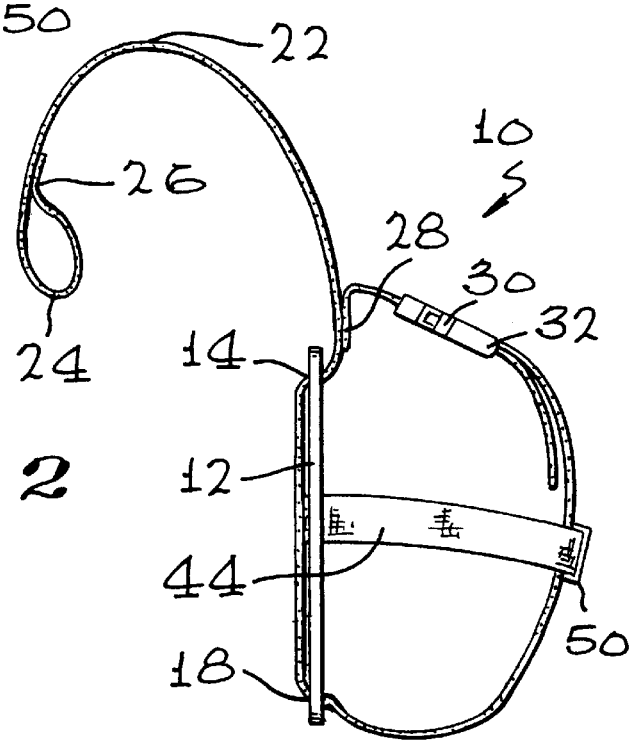
FIG. 2 is a side view of the back strap of FIG. 1.

As shown in the attached drawings for purposes of illustration, the present invention resides in a back strap, generally referred to by the reference number 10. The back strap includes a base 12, which is typically generally planar, and often quadrilateral in configuration so as to support books and other such similar objects as may be used in the school setting. The base 12 is sized such so as to support such books, yet be readily carried over the shoulder and back of a school age child. The base 12 includes a first upper aperture 14 and a second upper aperture 16 positioned adjacent to a top edge thereof. First and second lower apertures 18 and 20 are formed through the base 12 adjacent to a lower edge thereof, and generally in alignment with the first and second upper apertures 14 and 16.

A first shoulder strap 22 has a handle 24 formed at a first end thereof by creating a loop by attaching a first end 26 of the shoulder strap 22 to the strap, as illustrated. The shoulder strap is preferably comprised of a durable lanyard, canvas, or elastic material. Typically, the material is approximately 3½feet in length and several inches wide. The shoulder strap 22 is looped through the aligned first upper 14 and first lower 18 apertures and a second end 28 thereof is attached to the strap intermediate the first and second ends, and typically adjacent to the top edge of the base 12, in order to create a loop over a back side of the base 12.

An adjustment mechanism is incorporated into the shoulder strap 22 within the looped area over the base 12 in order to allow the tightening and loosening of the strap 22. In a particularly preferred embodiment, a clasp, such as the illustrated buckle 30 which includes mating ends is attached to free ends of the shoulder strap loop 22. One end of the buckle includes an adjustment mechanism 32 for loosening and tightening the shoulder strap loop 22, by adjusting the length of the strap 22 comprising the loop.

A second shoulder strap 34 similarly has a handle 36 formed at a first end thereof, as described above, and extends through the second upper base aperture 16 and lower base aperture 20 and has a second end thereof 38 attached to the strap 34, typically adjacent to the upper edge of the base 12, in order to create a second loop similar to that described above. The second shoulder strap 34 also includes a clasp or buckle 40 having an adjustment mechanism 42.

The first and second shoulder straps 22 and 34 are generally parallel to one another so that a handle 24 and 36 can be disposed over either shoulder of the child, with the first and second shoulder loops 22 and 34 being tightened around objects placed on the base 12 and slung over the child's back.

In order to further secure books and objects onto the base 12, first and second side straps 44 and 46 are attached to side apertures 48 of the base 12 and extend towards one another where mating ends of a buckle 50 can be attached to one another. Similar to that described above, the buckle 50 includes an adjustment mechanism 52 for adjusting the length of the side straps 44 and 46. Although two side straps 44 and 46 having a buckle 50 is shown, it should be understood by the reader that a single side strap having an adjustment mechanism can also be utilized, although it is not as convenient as the preferred embodiment illustrated.

In use, the buckles 30, 40, and 59 are opened to expose the back side of the base 12. Books and other such objects are placed onto the base, the buckles 30, 40 and 50 are attached to one another, and the lengths of the straps 22, 34 and 44–46 are adjusted to secure the objects thereon. The base 12 may include loops of elastic, apertures, etc. for carrying calculators, pens, etc. which may be difficult to strap onto the base 12. Preferably, the components of the invention are comprised of non-metallic material, such as plastic, so that the back strap 10 is relatively light and inexpensive, and so as not to activate metal detecting security equipment. The base 12, which holds the books in an upright position similar to a back pack, is swung over the child's shoulder onto the back, and one or more of the handles 24 or 36 are grasped near the chest area to carry the back strap 10. Once at school, the child may easily remove the books and objects from the back strap 10 and store such objects in his or her locker until further use is required.

Although several embodiments have been described in detail for purposes of illustration, various modifications may be made without departing from the scope and spirit of the invention. Accordingly, the invention is not to be limited, except as by the appended claims.

What is claimed is:

1. A back strap for carrying objects, such as books, comprising:

a base having a pair of spaced apart upper apertures adjacent to a top edge thereof, and a pair of spaced apart lower apertures adjacent to a bottom edge thereof;

a first shoulder strap having a first end defining a handle, the first shoulder strap extending through a first upper aperture and a first lower aperture, and having a second end attached to the strap intermediate the first and second end to form a loop over the base;

a second shoulder strap having a first end defining a handle, the second shoulder strap extending through a second upper aperture and a second lower aperture, and having a second end attached to the strap intermediate the first and second end to form a loop over the base;

an adjustment mechanism associated With each of the first and second shoulder straps for adjusting the length of each shoulder strap loop over the base;

a side strap extending from one side of the base to the opposite side of the base generally transverse to the first and second shoulder straps and forming a loop over the base; and an adjustment mechanism associated with the side strap for adjusting the length of the side strap loop over the base;

whereby objects are placed on the base and securely strapped thereto by tightening the first and second shoulder straps and side strap over the objects.

2. The back strap of claim 1, wherein the base is generally planar and quadrilateral in configuration.

3. The back strap of claim 1, wherein the side strap comprises first and second side straps extending from each side of the base and including clasps at free ends thereof for securing the first and second side straps to one another.

4. The back strap of claim 3, wherein the base includes side apertures through which the respective first and second side strap is attached to the base.

5. The back strap of claim 3, wherein the clasps comprise mating ends of a buckle, one end thereof including the adjustment mechanism.

6. The back strap of claim 1, wherein the shoulder strap handles comprise a loop formed by attaching the first ends to the strap.

7. The back strap of claim 1, wherein each of the first and second shoulder straps include clasps intermediate the first and second ends and disposed over the base.

8. The back strap of claim 7, wherein the clasps comprise mating ends of a buckle, one end thereof including the adjustment mechanism.

9. A back strap for carrying objects, such as books, consisting essentially of:

a generally planar and quadrilateral rigid base having a pair of spaced apart upper apertures adjacent to a top edge thereof, a pair of spaced apart lower apertures adjacent to a bottom edge thereof and side apertures adjacent opposing sides thereof;

a first shoulder strap having a first end defining a handle, the first shoulder strap extending through a first upper aperture and a first lower aperture, and having a second end attached to the strap intermediate the first and second end to form a loop over the base;

a second shoulder strap having a first end defining a handle, the second shoulder strap extending through a second upper aperture and a second lower aperture, and having a second end attached to the strap intermediate the first and second end to form a loop over the base;

a clasp having an adjustment mechanism associated with each of the first and second shoulder straps for adjusting the length of each shoulder strap loop over the base;

first and second side straps extending from each side aperture generally transverse to the first and second shoulder straps and cooperatively forming a loop over the base; and mating ends of a clasp attached to each free end of the first and second side straps, one clasp end including an adjustment mechanism for adjusting the length of the side strap loop over the base;

whereby objects are placed on the base and securely strapped thereto by tightening the first and second shoulder straps and side strap over the objects.

10. The back strap of claim 9, wherein the shoulder strap handles comprise a loop formed by attaching the first ends to the strap.

* * * * *